US012385670B2

(12) United States Patent
von Zur Muehlen

(10) Patent No.: US 12,385,670 B2
(45) Date of Patent: Aug. 12, 2025

(54) CABINET HEATER PLENUM THERMOSTAT CONTROLLER

(71) Applicant: The Marley Company LLC, Charlotte, NC (US)

(72) Inventor: Patrick Alexander von Zur Muehlen, Valparaiso, IN (US)

(73) Assignee: The Marley Company LLC, Charlotte, NC (US)

( * ) Notice: Subject to any disclaimer, the term of this patent is extended or adjusted under 35 U.S.C. 154(b) by 773 days.

(21) Appl. No.: 17/231,124

(22) Filed: Apr. 15, 2021

(65) Prior Publication Data

US 2022/0333820 A1 Oct. 20, 2022

(51) Int. Cl.

| | |
|---|---|
| ***F24H 15/204*** | (2022.01) |
| ***F24D 5/04*** | (2006.01) |
| ***F24D 15/02*** | (2006.01) |
| ***F24D 19/10*** | (2006.01) |
| ***F24H 3/02*** | (2022.01) |
| ***F24H 3/04*** | (2022.01) |
| ***F24H 9/02*** | (2006.01) |
| ***F24H 9/06*** | (2006.01) |
| ***F24H 15/355*** | (2022.01) |

(52) U.S. Cl.

CPC ..... *F24H 15/204* (2022.01); *F24D 5/04* (2013.01); *F24D 15/02* (2013.01); *F24H 3/02* (2013.01); *F24H 3/0411* (2013.01); *F24H 3/0417* (2013.01); *F24H 9/02* (2013.01); *F24H 9/06* (2013.01); *F24H 15/355* (2022.01); *F24D 19/1096* (2013.01)

(58) Field of Classification Search

CPC ..... F24H 3/0417; F24H 9/2064; F24H 3/02; F24H 9/02; F24H 9/06; F24H 15/355; F24H 15/204; F24H 3/0411; F24D 5/04; F24D 15/02; F24D 19/1096

See application file for complete search history.

(56) References Cited

U.S. PATENT DOCUMENTS

| | | | | |
|---|---|---|---|---|
| 6,466,737 | B1 | 10/2002 | Birdsell et al. | |
| 2006/0006167 | A1 | 1/2006 | Kopel | |
| 2006/0048519 | A1 | 3/2006 | Childress | |
| 2010/0178041 | A1 * | 7/2010 | Rookstool ..... | F24H 7/0416 29/428 |

(Continued)

OTHER PUBLICATIONS

International Search Report and Written Opinion issued for International Application No. PCT/US2022/024766 dated Jul. 12, 2022, 7 pages.

*Primary Examiner* — Michael G Hoang
*Assistant Examiner* — Kurt J Wolford
(74) *Attorney, Agent, or Firm* — Husch Blackwell LLP

(57) ABSTRACT

A cabinet heater system and devices comprising an air plenum thermostat controller are discussed herein. Embodiments of the present invention include a cabinet heater system comprising a housing, and a thermostat mounted within an air plenum formed within a cavity of the housing, configured to sense air plenum temperature and maintain a set temperature. A mounting unit secure positioning of at least one of a heating unit, an air moving device, and the thermostat. A control compartment, separate from the air plenum cavity can further house controls configured to adjust the thermostat and one or more components of the cabinet heater system and devices.

20 Claims, 11 Drawing Sheets

(56) References Cited

U.S. PATENT DOCUMENTS

| | | | | |
|---|---|---|---|---|
| 2010/0254686 | A1* | 10/2010 | Tyburk | H05B 3/44<br>392/373 |
| 2010/0307733 | A1 | 12/2010 | Karamanos et al. | |
| 2014/0041847 | A1 | 2/2014 | Mulder | |
| 2015/0030318 | A1* | 1/2015 | Tyburk | F24F 13/30<br>392/375 |
| 2019/0128564 | A1* | 5/2019 | Kallarakal | F24H 15/37 |

* cited by examiner

CABINET HEATER PLENUM THERMOSTAT CONTROLLER

FIELD OF THE INVENTION

This invention relates generally to a cabinet heater system. More particularly, the present invention relates, for example, to an air plenum thermostat controller usable with a suitable cabinet heater system.

BACKGROUND OF THE INVENTION

Generally, cabinet unit heaters are designed to maintain temperature within a designated area, such as rooms within residential homes, a garage, or other enclosure. While commonly used to heat small or enclosed areas, cabinet unit heaters can be implemented to assist with temperature maintenance, e.g., for cables, computer equipment, and other electronics, within designated areas. Various cabinet unit heater sizes are available to provide a power output appropriate to the desired heating requirements.

Traditional cabinet unit heaters sense the temperature of incoming air in order to determine heating requirements and utilize a temperature sensor within the unit itself. Heater controls are typically located within a separate control compartment, and require a remote temperature sensor, located in the air plenum, to sense the incoming air. Thus, the remote temperature sensor must be physically wired to the main controller in the control compartment.

Installation and preparation of such configurations are labor intensive and often require a technician or other skilled worker to properly configure and wire the thermostat controls in the control panel and run the remote temperature sensors into the plenum (for a thermostat with an integral remote temperature sensor) or separately connect a remote sensor to the thermostat if necessary. Each of the hardware parts—the controller, the wires, and the temperature sensor (s)—must be routinely monitored and maintained, since any issues with these temperature control mechanisms will affect the effectiveness of the cabinet unit heater to properly maintain the temperature of its designated area. Such configurations are found in both electro-mechanical and electronic based cabinet unit heater controls and face the challenges noted above. Accordingly, there is a need to improve the design of cabinet heaters to reduce the necessity of routine hardware maintenance and improve efficiency and effectiveness in performance.

SUMMARY OF THE INVENTION

The foregoing needs are met, to a great extent, by the present invention, wherein aspects of a cabinet heater and air plenum thermostat controller, as discussed herein.

An embodiment of the present invention pertains to a cabinet heater comprising: a housing forming a cavity comprising a heating unit and an air moving device, a thermostat mounted within the cavity, the thermostat comprising an internal temperature sensor configured to sense temperature within an air plenum formed in the cavity and configured to adjust at least one of the heating unit and air moving device to maintain a set temperature within the air plenum, a mounting unit securing a position of at least one of the heating unit, the air moving device, and the thermostat, a control compartment, separate from the cavity, housing controls configured to adjust the thermostat.

In various embodiments, the cabinet heater can further comprise a thermostat mount positioned within the cavity further comprising an upper bar secured to the mounting unit and a first plate, a second plate positioned beneath the first plate and attached to the thermostat, a stability bar positioned behind the second plate and securing the housing to prevent movement of the mounting unit. The thermostat mount can further comprise at least one of: a wire protector, a wire pathway, and a strain relieving grommet. In additional embodiments the thermostat can be mounted within the cavity using at least one hook to secure a position of the thermostat within the cavity.

In addition, the heating unit can be secured on an upper face of the mounting unit and the air moving device secured on a bottom face of the mounting unit. In embodiments, an area above the mounting unit containing the heating unit is thermally separated from an area below the mounting unit. Moreover, the areas above and below the mounting unit can be thermally separated using one or more of: an air-blocking baffle, a cover placed on the mounting unit, and insulation panels.

In other embodiments, the housing can comprise a removable outer panel enclosing the cavity. The outer panel can comprise an insulation layer and the outer panel can be removably coupled to the housing with at least one hinge. The housing can also comprise one or more panels removably covering the cavity and the control compartment. In embodiments, the cabinet heater of claim 1, wherein the air-moving device is a cylindrical blower.

The controls, within the control cabinet, can be configured to adjust the thermostat in response to received temperature information. As discussed herein, the controls can be configured to execute a program comprising automatic adjustments to the thermostat. Such adjust can be operated through various means and methods, such as through at least one of: manual, remote, digital, and automatic adjustments. Such controls can be further configured to adjust the heating unit and the air-moving device.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Various embodiments of the present invention provide for an improved cabinet heater and plenum thermostat controller. Examples include electro-mechanical and electronic-based configurations. In various embodiments, a control thermostat with internal temperature sensor can be mounted in the inlet air plenum to control the unit. The controller can be connected via wire, for example, to the heater and fan relays, and allow for a simpler system architecture. Advantages of the present embodiments allow for use of electronic controls, without the traditional requirement of remote temperature sensors. Embodiments of the present invention allow for use of off-the-shelf, standard components, such as thermostats, which provide increased efficiency with respect to aspects such as heater construction, design, repair, and modification. The present invention provides an improved, customizable assembly configuration, that is readily adaptable to various environments and heating purposes, while reducing maintenance requirements and eliminating needs for designing customized, on-board electronics. The use of a thermostat within the air plenum further overcomes limitations of traditional designs, and heaters having a remote sensor within the air plenum. In addition, since the air plenum is cooler than the control compartment, the electronics are not exposed to as high of a temperature range, which thereby results in a greater lifespan of such electronics.

Figure 1:
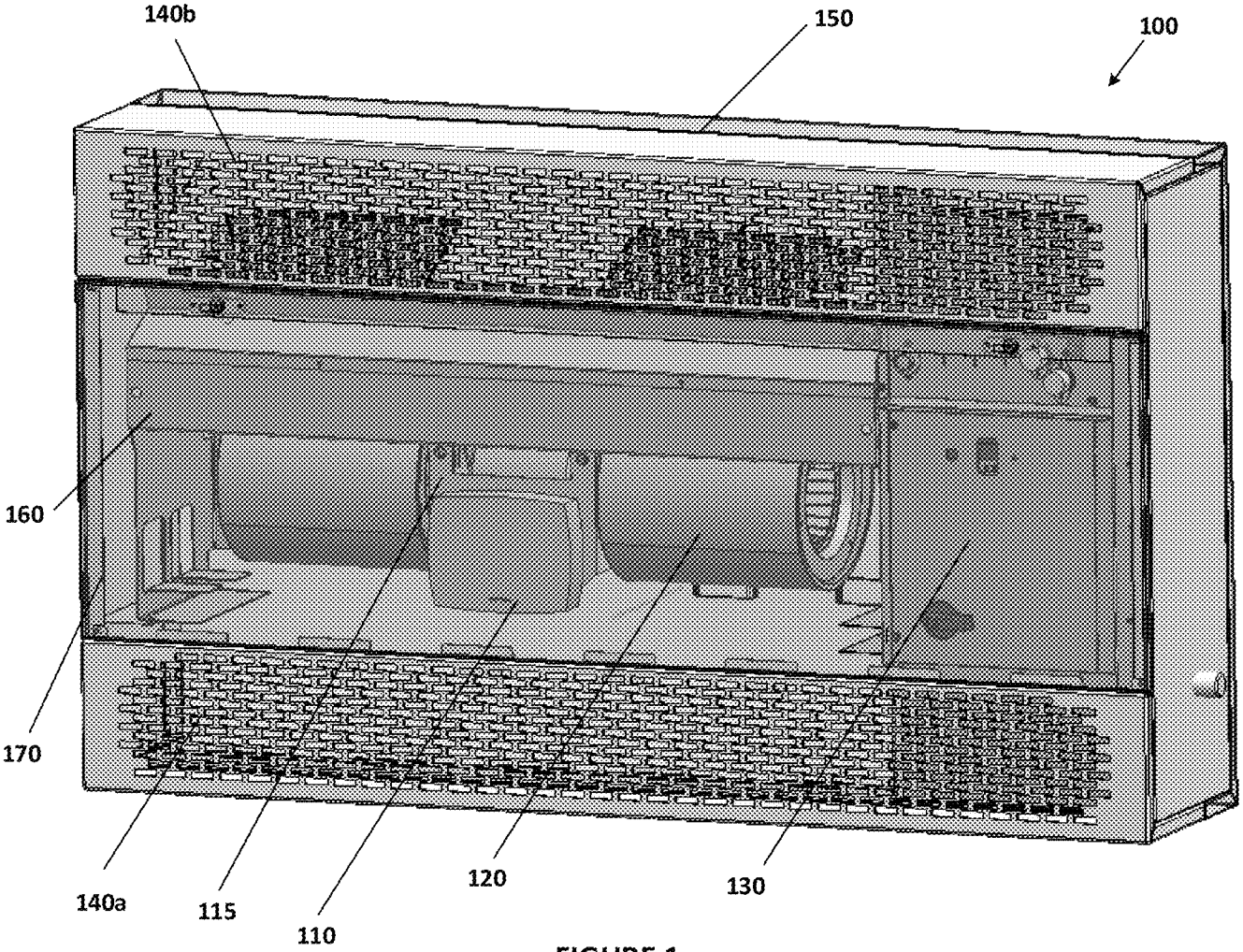
FIG. 1 illustrates a cabinet heater system in accordance with embodiments.

Turning now to the drawings, FIG. 1 illustrates a cabinet heater 100 in accordance with embodiments discussed herein. A housing unit 150 encloses a plurality of components within a cavity and can provide a foundation for mounting such components. The housing unit can comprise one or more grilles 140*a*, 140*b*, which cover air intake and exhaust features. A secure mounting unit 160 can be formed as part of the housing unit 150, or fitted and attached into the housing unit to securely position one or more components, such as a thermostat 110, a mounting 115 for the thermostat, at least one air moving devices 120, such as a blower or a fan, air intake features, air output features, and at least one heating unit, as discussed herein.

The cabinet heater 100 can comprise at least two sections, which separate a control cabinet 130 from a main cavity 170 containing the thermostat 110, heating elements, and mounting components 115, 160. In embodiments, the control cabinet section 130 can contain one or more controls, as discussed herein, to manage one or more components within the cabinet heater 100 system. For example, the control cabinet 130 can house controls to adjust the thermostat, an air moving element, a heating element, and one or more aspects associated with each device.

In embodiments, the thermostat 110 is located within an air plenum of the cabinet heater 100. The thermostat can comprise an onboard temperature sensor configured to sense air temperature within the main cavity. In embodiments, the thermostat comprises at least one processor configured to execute one or more programs to adjust a temperature within the cavity, through operation of at least one of heating elements and air movement devices. The thermostat can be configured to communicate with at least one of a remote control system and a computing device. The thermostat can, for example, provide updates regarding the sensed temperature, and execute a program to maintain one or more set temperatures for a given period of time. The thermostat can be wired or wireless, and connected to other components and computing devices, including the control devices.

As illustrated in FIG. 1, the thermostat is positioned such that it can measure an air temperature within the air plenum, located within the main cavity 170 of the cabinet heater 100. In embodiments, the thermostat is in communication with at least one of the air moving devices, such as a blower, and heating elements. The thermostat can be configured to adjust an operation of one or more components in order to maintain a set temperature.

The positioning of a thermostat within the air plenum allows for more accurate air measurement and, compared to traditional heating systems, reduces the amount of wiring and components necessary needed to connect a temperature sensor to a remote thermostat and remote control system.

As discussed herein, the thermostat can further be in communication with a control system, which can be located within the control cabinet 130. The control system can program the thermostat to execute one or more operations, such as temperature settings, in order to maintain a desired temperature and output of the cabinet heater system 100. In addition, the control system can be configured to adjust the receive temperature information from the thermostat and adjust the one or more settings of the thermostat in response to the received temperature information. Likewise, a program can be set, which comprises automatic adjustments to the thermostat. For example, the programmed set temperature on the thermostat can be changed based on a time of day or year. The set temperature could also be triggered in response to a certain temperature reading, such as the temperature going above or below a certain threshold temperature. In various embodiments, the control system can further be configured to adjust one or more of the heating unit and air-moving device. Such controls can be in addition to the thermostat's control, for example, or in response to a failure or other issue with the thermostat.

In embodiments, the control system can comprise a computing device or be in communication with one or more computing devices. Such communication can be wired or wirelessly connected to one or more computing devices. In addition, the control system can be manually controlled, remotely controlled, automatically controlled, or a combination of any of the above, as discussed herein.

In additional embodiments, the control system can comprise be manual controls, comprising a plurality of physical features, such as one or more buttons, switches, and levers, located within the control cabinet. In other embodiments, the controls can comprise digital controls, for example, and/or at least one screen, such as a touch screen, to adjust one or more operations of the cabinet heater system. It will be appreciated that the design of the control features can take any of a plurality of forms, such as digital, computer-controlled, manually-operated, and remote controls.

In additional embodiments, the control section can be kept open for easier access. In other embodiments, a panel 130 can be placed over the controls for aesthetic purposes, shielding, protection, and the like. The panel 130 can be fully or partially removable. In embodiments the panel can be a door. The panel 130 can be locked, or otherwise secured, for example, to prevent unintentional exposure of the controls, protect the controls from damage, maintain a certain temperature within the cabinet section, among others. The panel can comprise a layer of insulation. As discussed herein, one or more panels can cover the control cabinet and the main cavity. In embodiments, each section can be accessed separately. In other embodiments, each section is accessed upon removal of the panel.

Figure 2:
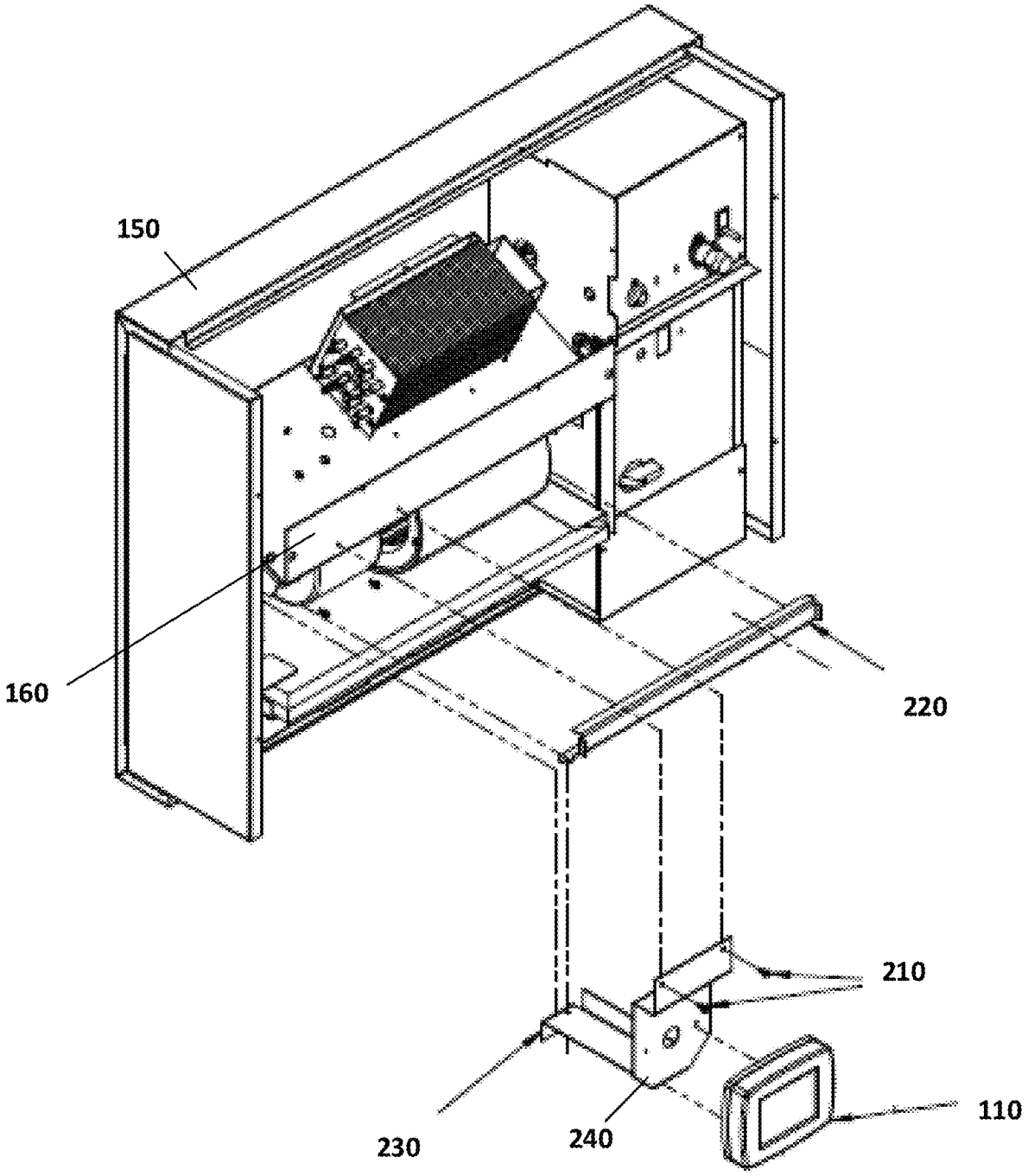
FIG. 2 is a partially disassembled perspective view of a thermostat mounting mechanism in accordance with embodiments.

FIG. 2 illustrates a mounting mechanism for placement of a thermostat 110 within a main cavity of the housing unit. The mounting mechanism can comprise an upper bar 220 secured to the mounting unit 160 attached to the housing unit 150. In embodiments, the mounting unit 160 can be removably attached to the housing unit 160 via one or more fasteners. Similarly the upper bar 220 can be removably attached to the mounting unit 160 via one or more fasteners.

The upper bar 220 is further secured to a first plate 210 formed above which a second plate 240 onto which the thermostat 110 is affixed. In embodiments, the upper bar is a horizontal bar affixed to the mounting unit 160. In other embodiments, at least one of the plates are vertically positioned, and located beneath the upper bar 220. In embodiments, the first plate 210 and second plate 240 can formed as a single fixture, or comprise two or more plates and connected via fasteners. In embodiments one or both of the first plate 210 and the second plate 240 are positioned vertically and different heights. The positioning of the thermostat mounting mechanism can be adjusted, depending on a preferred placement of the thermostat. In examples, the mounting mechanism can be secured along various lengths of the upper bar 220. Such placements can depend on the positioning of air blowing, heater elements, and other components within the main cavity, in addition to other considerations, such as an overall size of the cabinet heater, a size of the main cavity, an ideal position for determining air temperature, and other considerations.

A stability bar 230 positioned behind the second plate 240 can provide additional security and support, to prevent movement of the thermostat mounting mechanism. The stability bar can be mounted to the frame of the housing unit 150, for example, or attached to one or more components within the main cavity. In embodiments, the stability bar can be attached to one or more components within the main cavity using fasteners, adhesives, and the like. In embodiments, the mounting mechanisms discussed herein can be formed of metal, steel, or other durable material that can withstand the temperatures and temperature fluctuations occurring within the cabinet heater during operation. It will be appreciated that any of a plurality of materials, and combination of materials can be used in accordance with embodiments discussed herein.

Figure 3:
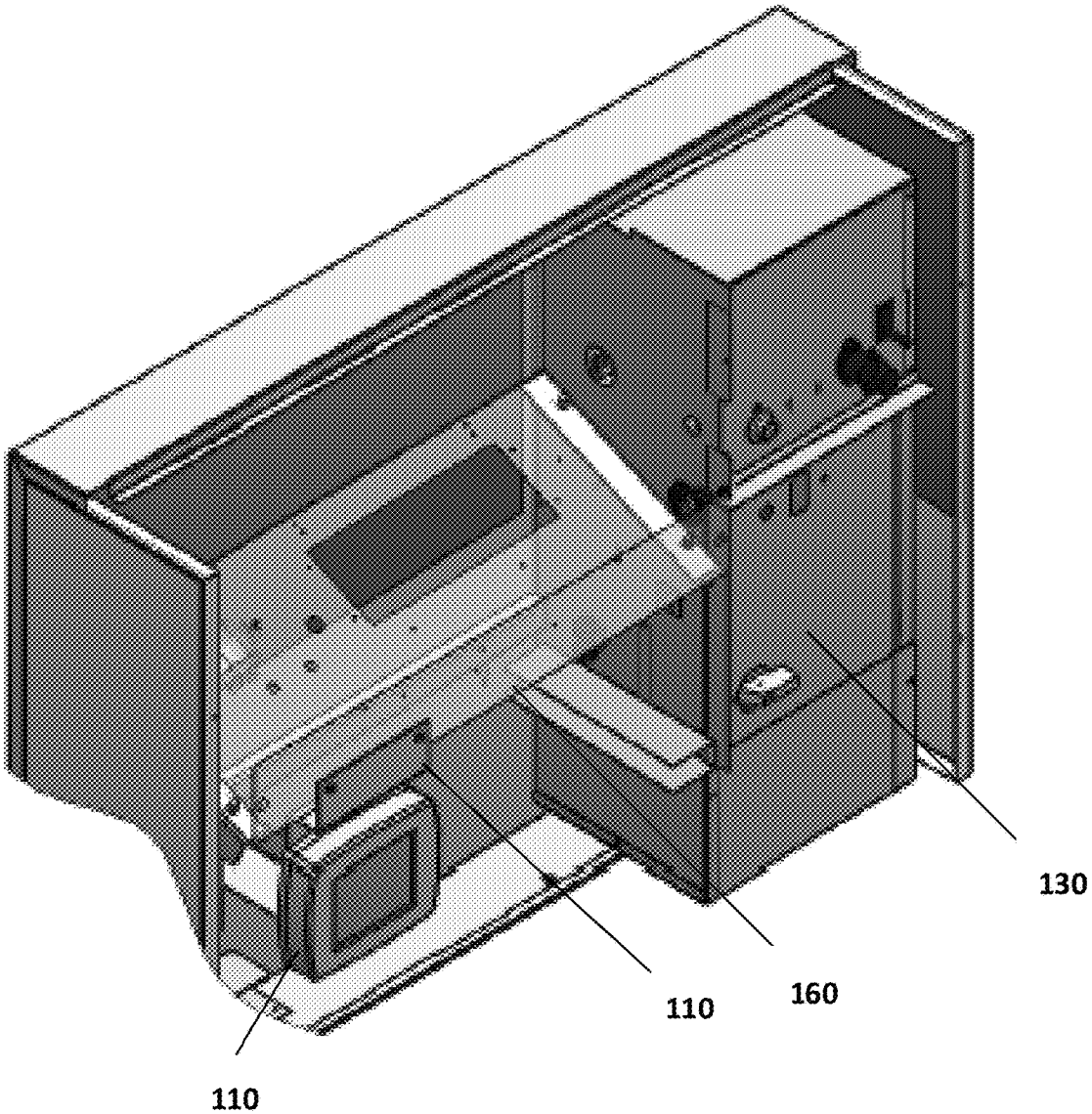
FIG. 3 is an internal view of the cabinet heater system in accordance with embodiments.

FIG. 3 illustrates an example of a mounted thermostat, as discussed herein. In examples, the thermostat 110 is mounted directly to the mounting unit 160. In such embodiments the upper bar 220 is formed as part of the mounting unit 160. As illustrated in FIG. 3, one or more fasteners, such as screws, can be used to connect mounting components. The thermostat 110 and thermostat mounting mechanism is positioned beneath the mounting unit, and positioned beneath a platform for one or more heating elements. In embodiments, the mounting unit is secured to the housing unit 150 and comprises a fixture onto which one or more of the air moving element, heating element, thermostat mounting unit, and thermostat 110 can be affixed.

Figure 4:
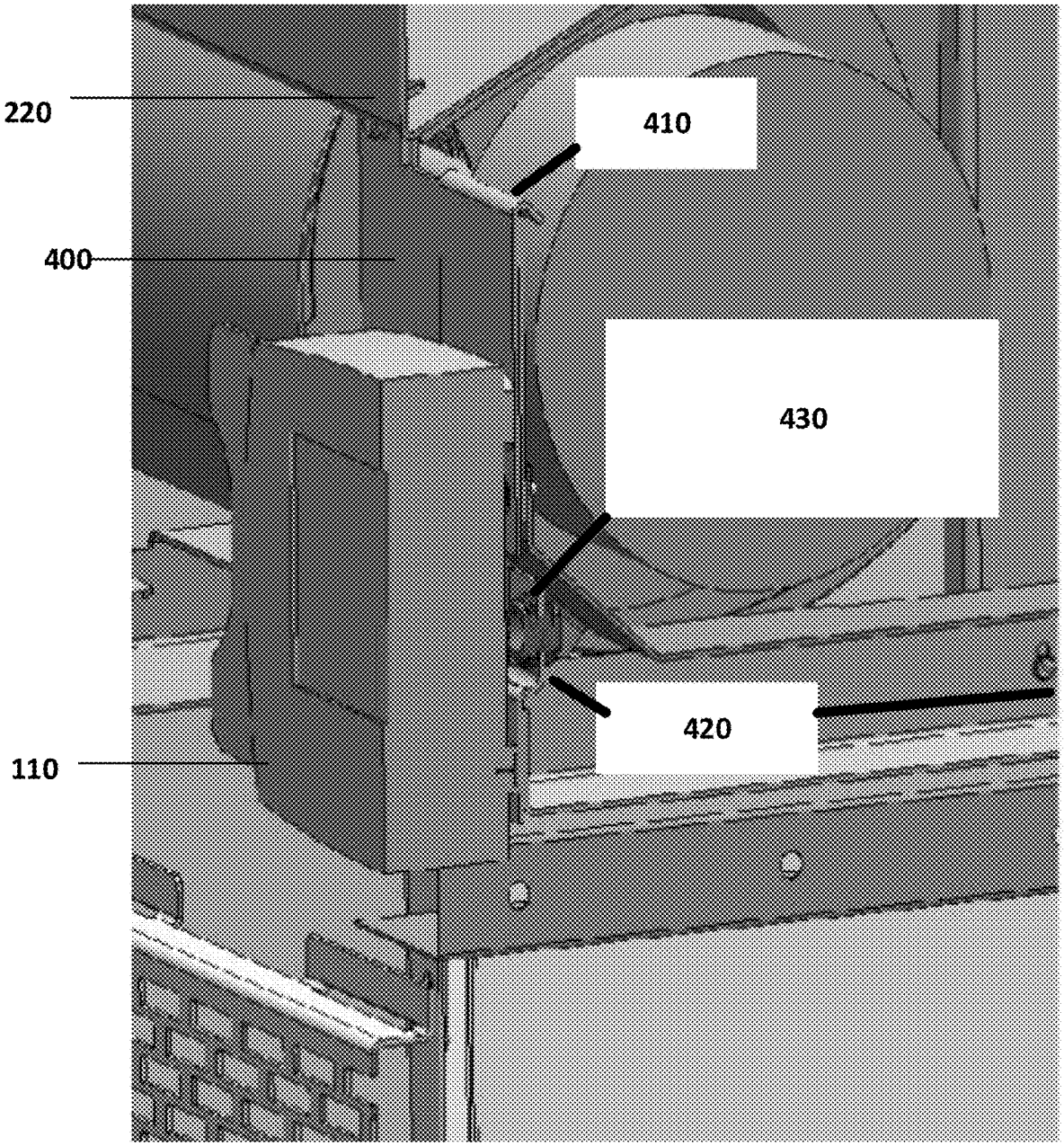
FIG. 4 is a partial cross-sectional view of features related to thermostat mounting mechanisms in accordance with embodiments.

FIG. 4 illustrates a side view of a thermostat mounting mechanism, in accordance with embodiments. The thermostat can be secured to a plate 400 comprising a hook 410. In embodiments, the plate 400 can be the first plate 210 or the second plate 240. The hook can form an upper edge of the plate 400, an act as a securing mechanism to the upper bar 220, which, in various embodiments, can be attached to the mounting unit 160 and/or form a part of the mounting unit 160. In embodiments, the hook can allow for selective attachment to the upper bar 220, so that the thermostat 110 and/or the thermostat mounting mechanism can be removed from the main cavity of the cabinet heater system. The hook 410 can be used instead of or in addition to one or more fasteners, in order to provide stability in positioning of the thermostat mounting unit. Likewise, the hook can be functional to adjust a movement of the thermostat mounting mechanism along a length of the upper bar. In embodiments, there may be one or more grooves or attachment points onto which the hook 410 of the plate 400 can attach.

In addition, the mounting plate 400 can further comprise a grommet 430, which can be a strain relieving grommet, e.g., for a wire pigtail. In some embodiments, as discussed herein, the thermostat can comprise one or more wires, which are functional for any of a variety of purposes, including but not limited to providing power, transferring information, sending signals to a local or remote device, and operation of one or more components within the cabinet heater. The grommet 430 can be provided on the mounting plate 400 to reduce strain on the wire, contact with other components, and generally decrease a risk for damage, pinching, and malfunction, in order to maintain, or even increase a lifespan of components. It will be appreciated that while a grommet is illustrated as an exemplary feature, similar components, such as wire coverings, protectors, dedicated pathway, and the like, can be used for similar purposes and to maintain the integrity and functionality of the wires and other physical components.

As further illustrated in FIG. 4, any wires and physical components coming from the thermostat 110 can travel through a wireway 420. The wireway 420 can be a pathway leading the wires to their various destinations, such as to power, to a computing device, to various components within the cabinet heater, among others. The wireway can be formed as part of the stability bar 230, as discussed herein, with respect to FIG. 2. In other examples, the wireway, can be a dedicated pathway formed by one or more bars, wire coverings, insulated areas, and other dedicated spaces. In embodiments, the wireway 420 can be insulated to prevent damage from heat within the air plenum and main cavity and protect against temperature fluctuations that can occur.

Figure 5:
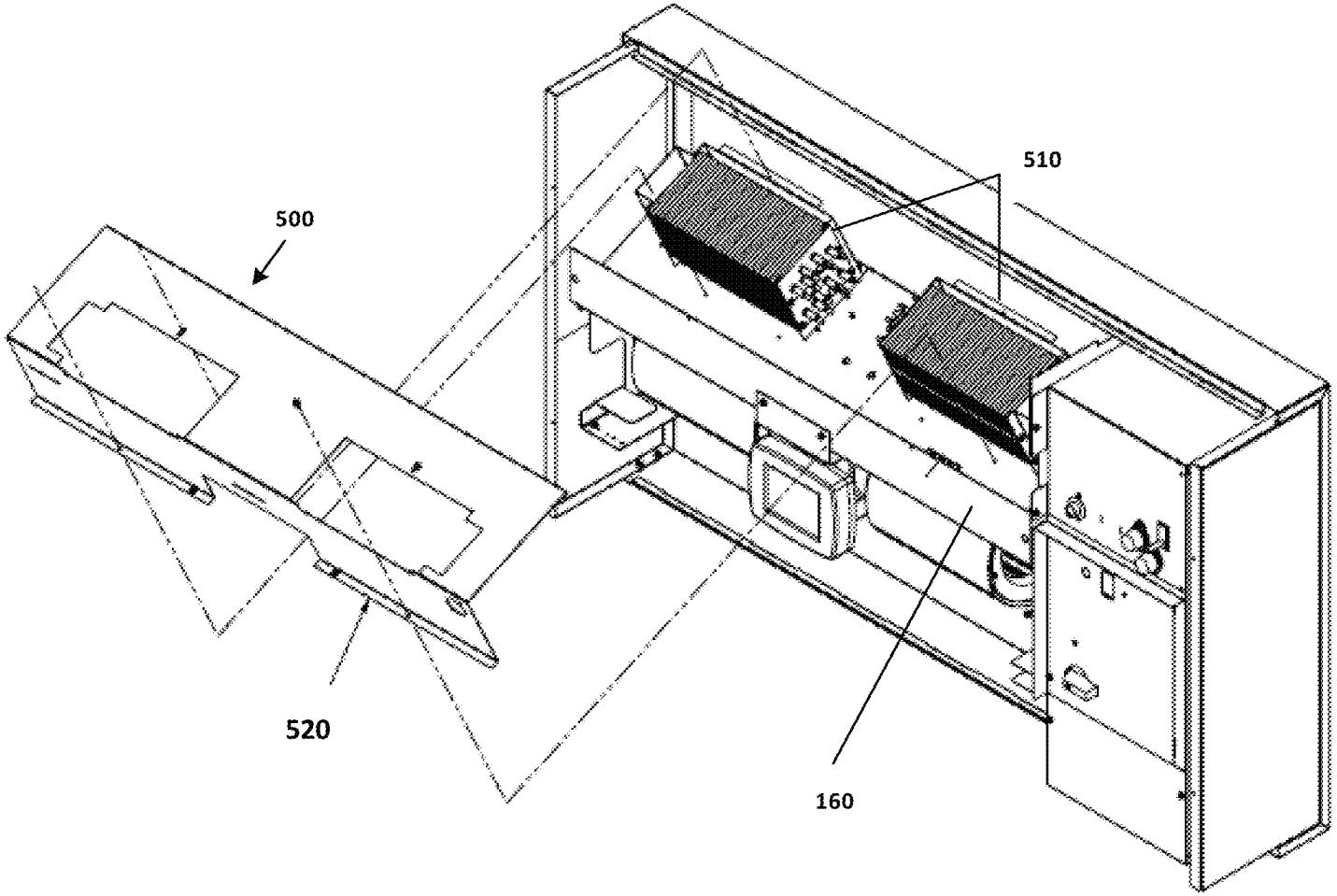
FIG. 5 is a partially disassembled perspective view of features of a cabinet heater system in accordance with embodiments.

FIG. 5 illustrates a cover than can be placed between the mounting unit 160 and the heating elements 510. As discussed herein, one or more heating elements 510 can be mounted on an upper side of the mounting unit 160, such that the thermostat 110 is positioned below the mounting unit, within an air plenum 530 formed in the main cavity of the cabinet heater. In embodiments, the covering can comprise a curved edge 520, which can aid in securing a position of the cover 500 when installed. In other embodiments, the curved edge 520 can be an edge onto which a hook 410 of the thermostat mounting unit can attach. In additional embodiments, the cover 500 can be insulated to prevent heat from transferring between the heating element section and the air plenum below. The cover can further prevent air transfer from the air plenum and the upper portion containing the heating elements 510. As illustrated in FIG. 5, the cover 500 can be designed to connect with the mounting unit 160.

Figure 6:
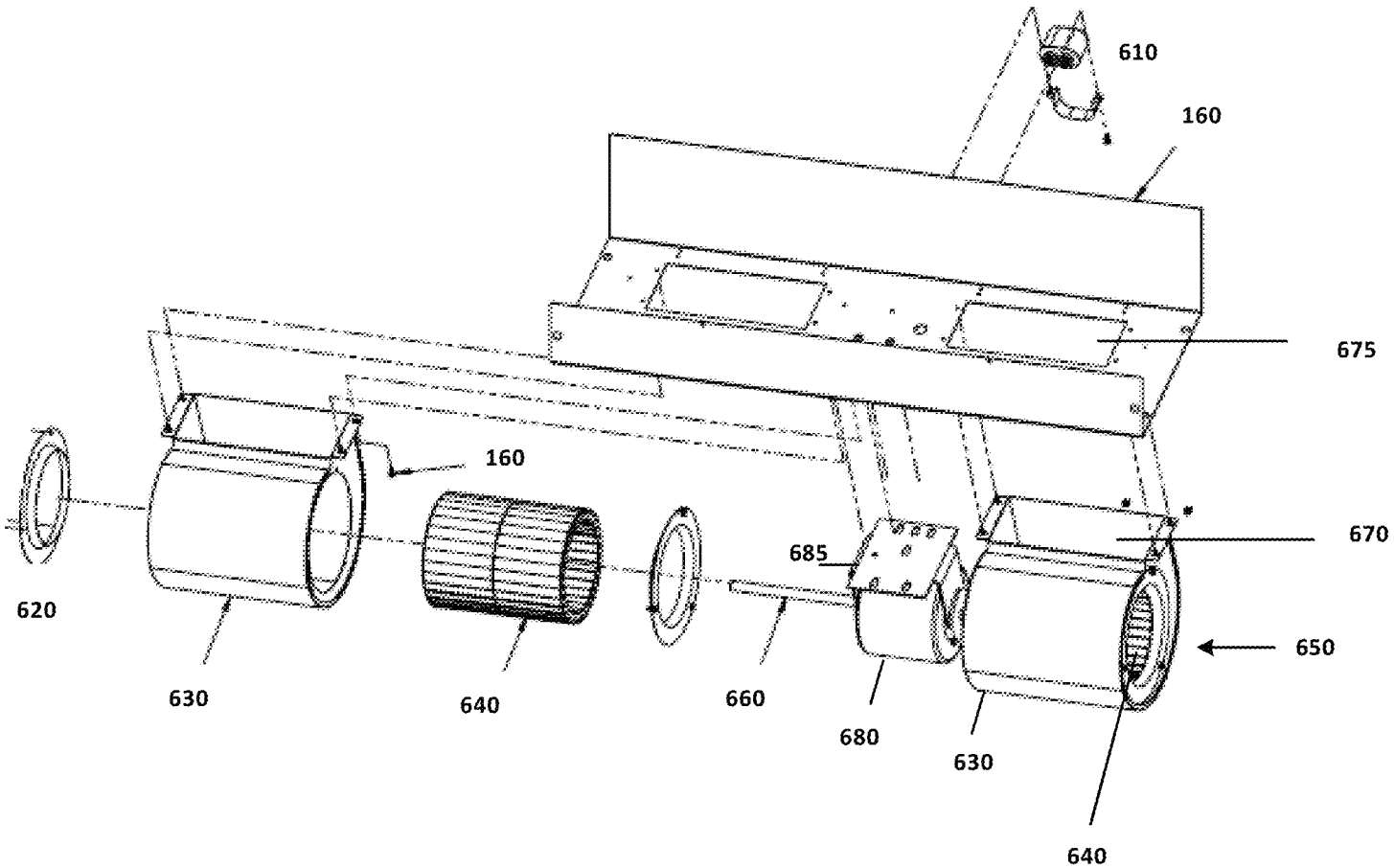
FIG. 6 is disassembled perspective view of air moving units and a mounting unit in accordance with embodiments.

FIG. 6 illustrates an attachment of air moving units 650 onto the mounting unit 160. Embodiments in accordance with the present invention can comprise one or more air moving units, comprising blowers, fans, and the like. The air moving units 650 can comprise a motor shaft 660 configured to rotate via a motor, a blower housing unit 630, a blower wheel 640 rotatable via the motor shaft 660, and one or more end caps 620. In the depicted embodiment, there are two air moving units 650 attached to the mounting unit 160. However, it will be appreciated that one or more air moving units 650 can be incorporated in accordance with embodiments discussed herein, and each variation falls within the scope of the disclosure and designs presented herein.

The attachment of the blowers to the mounting unit 160 can occur using any of a plurality of attachment methods. In an example, a plate 670 formed on or attached to the blower unit 650 can be secured to a mounting area 675 on the mounting unit 160. In embodiments, one or more screws, adhesives, fasteners, and the like can serve to attach the two components together. In embodiments, a similar plate attachment configuration can be used to secure a motor unit 680 to the mounting unit. A plate 685 can be formed on or attached to the motor unit 680 to attach to a bottom side of the mounting unit 160.

In various embodiments, an attachment 610 can be used to affix one or more components of the air moving units 650 to the mounting unit 160. Such attachments can be a removable, U-shaped faster, mounted on a bottom side of the mounting unit.

Figure 7:
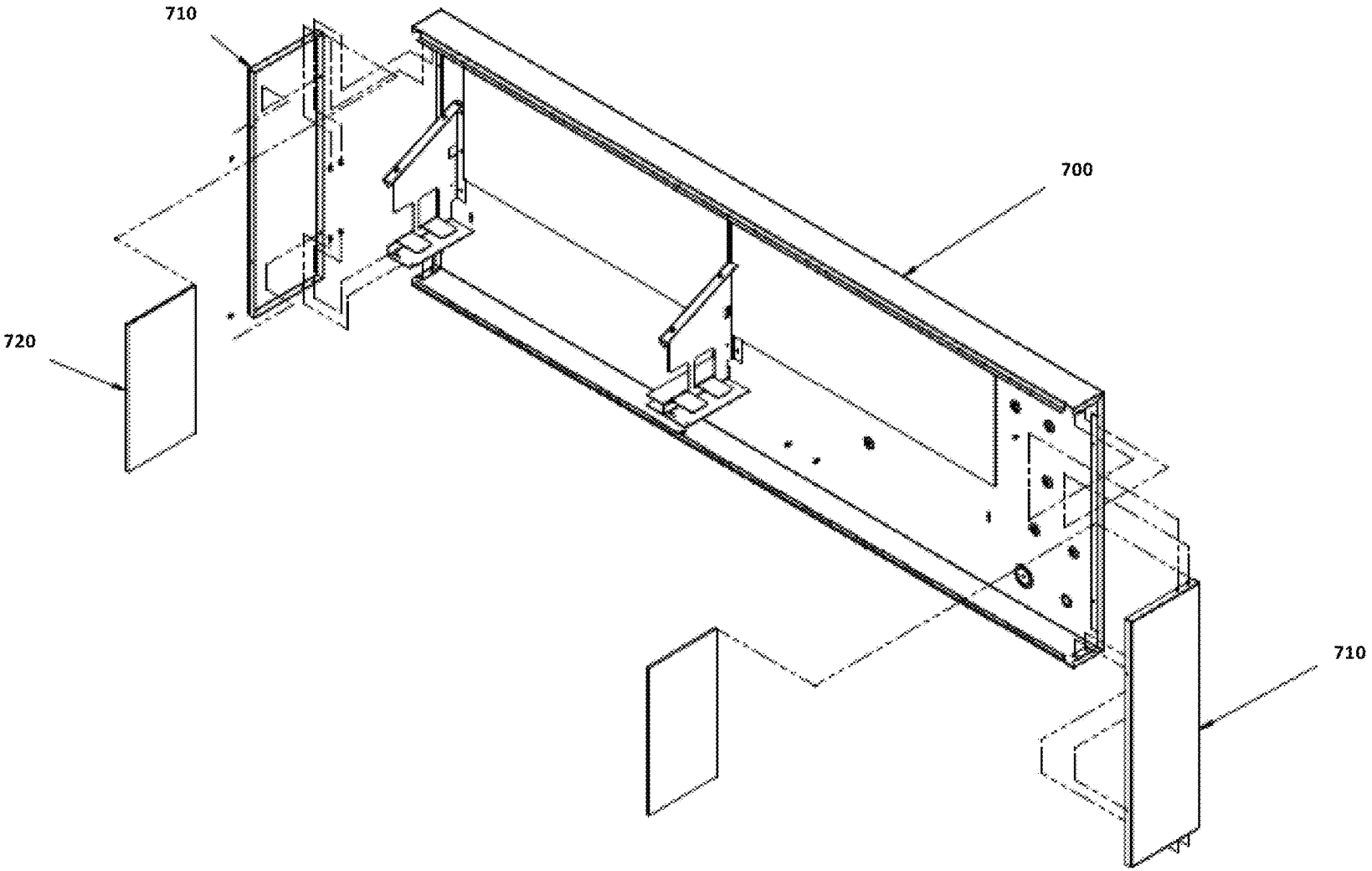
FIG. 7 illustrates a back panel in accordance with embodiments.

FIG. 7 illustrates a back panel 700 on which the mounting unit 160 can be affixed. In embodiments, the back panel 700 can be fitted and secured into the cavity of the cabinet heater, thereby providing a base onto which the mounting unit 160 and the various heating, air blowing, and thermostat components can be secured. In various embodiments, the back panel 700 can be a removable fixture, secured to the housing unit 150. In other embodiments, the housing unit 150 can be designed so as to form the back panel 700. That is, the housing unit 150 comprises the features and fixtures of the back panel 700.

The back panel 700 can comprise a plurality of side panels 710 that can be fitted and/or formed with insulation 720. The side panels 710 and optional insulation 720 can assist in providing thermally separated areas within the cabinet heater, and within the main cavity, if desired. In addition, the side panels 710 can serve to separate the main cavity with the control unit cabinet section, as discussed herein. In embodiments, the insulation can extend along an entire length of the back panel 700, in order to prevent heat loss and/or heat transfer between sections of the cabinet heater. In addition, an air-blocking baffle can be installed to prevent air transfer between sections of the main cavity, or between areas of the air intake and air output components. Such baffles can be installed to assist in maintaining a set temperature within the main cavity and prevent heat loss.

Figure 8:
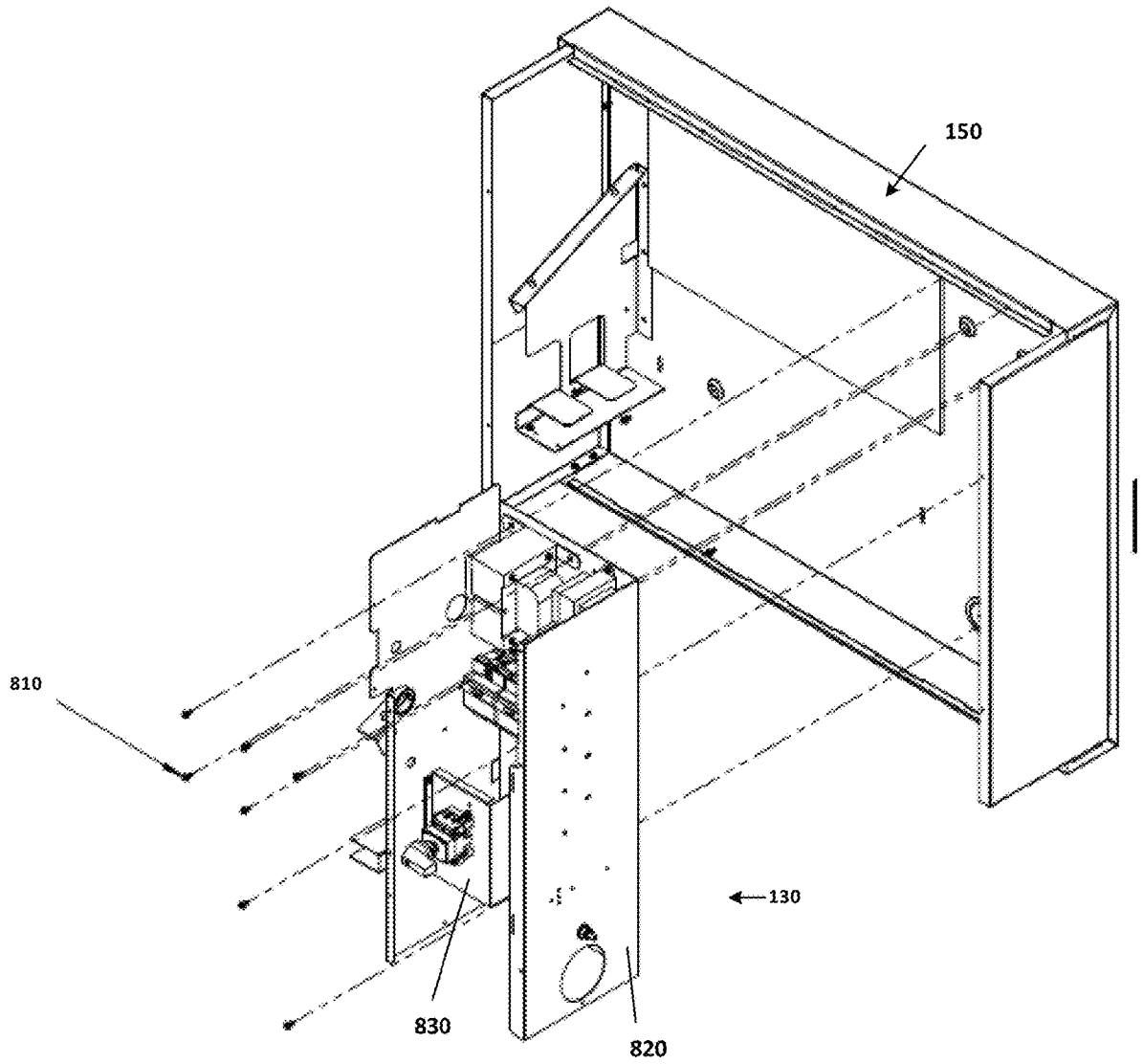
FIG. 8 illustrates an example of a control cabinet's positioning within a housing unit of the cabinet heater system in accordance with embodiments.
Figure 9A:
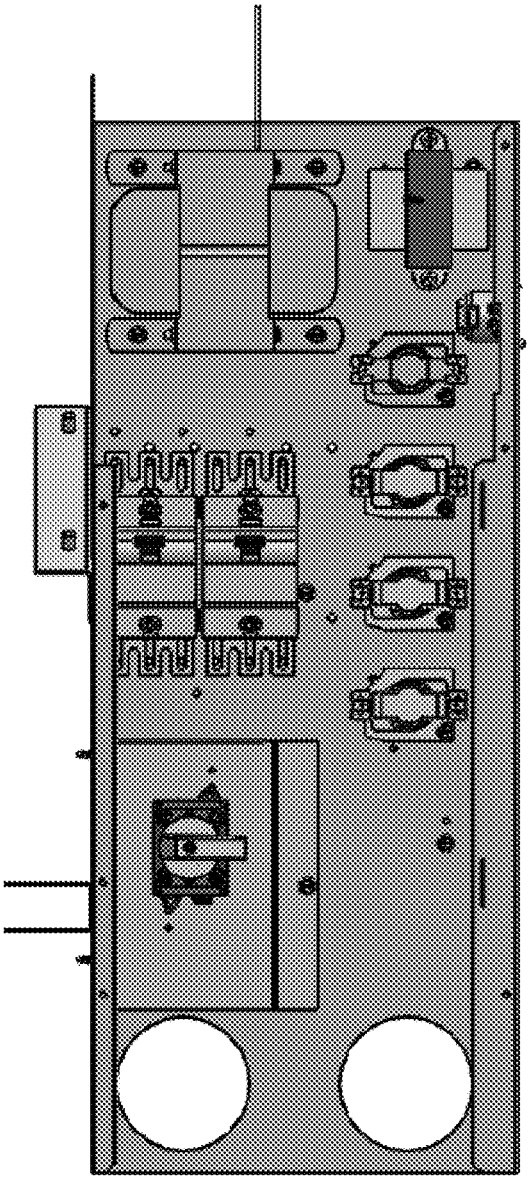
FIG. 9A illustrates a front view of control cabinet components in accordance with embodiments.
Figure 9B:
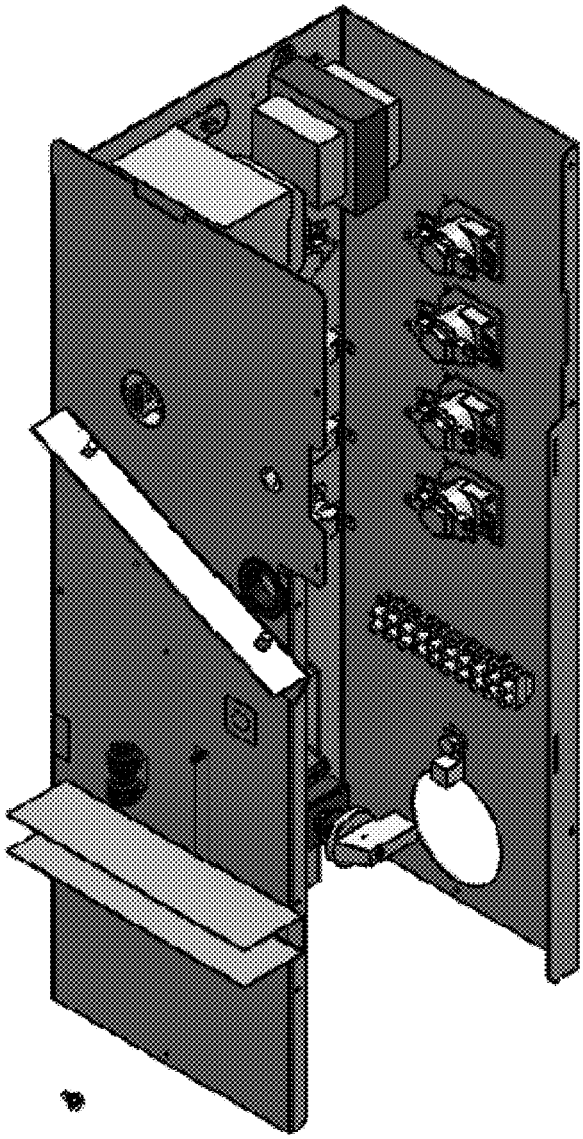
FIG. 9B illustrates a perspective view of control cabinet components in accordance with embodiments.

FIGS. 8 and 9A-9B illustrate embodiments of the control cabinet 130, and positioning within the housing unit 150. As illustrated in FIG. 8 and discussed herein, the control unit can comprise a plurality of controls 830 configured to adjust an operation of one or more components of the cabinet heater. The control unit can be affixed to a back section of the housing unit 150 using a plurality of fasteners 810, such as screws. The control cabinet can comprise side panels 820, which can contain insulation, in order to prevent heat transfer between the control cabinet and the main cavity. The prevention of heat transfer assists in providing a more accurate reading of air plenum temperatures, and prevents heat generated by the controls 830 in the control cabinet 130 to affect the temperature within the main cavity. Similarly, the insulation can prevent the heat and temperature fluctuations from affecting and/or otherwise damaging components and controls 830 within the control cabinet. As such, a more accurate temperature reading of the air plenum temperature, as a result of the heating and air moving devices can result.

FIGS. 9A-9B provide a front view and angled view, respectively, of the control cabinet 130. In embodiments, the control cabinet can comprise a plurality of manual features, which an operator can operate to adjust one or more components within the cabinet heater system. In addition, the separate control cabinet allows an operator to access such controls without exposing components within the main cavity and affecting operation of the heating elements, air blowing units, and general operation of the device. As illustrated, the control cabinet can be affixed to the housing, and may be removably attached to the housing 150. In other embodiments, the control cabinet can be formed as part of the housing unit's structure. Any of a variety of designs and implementation methods can be used in accordance with embodiments discussed herein.

Figure 10B:
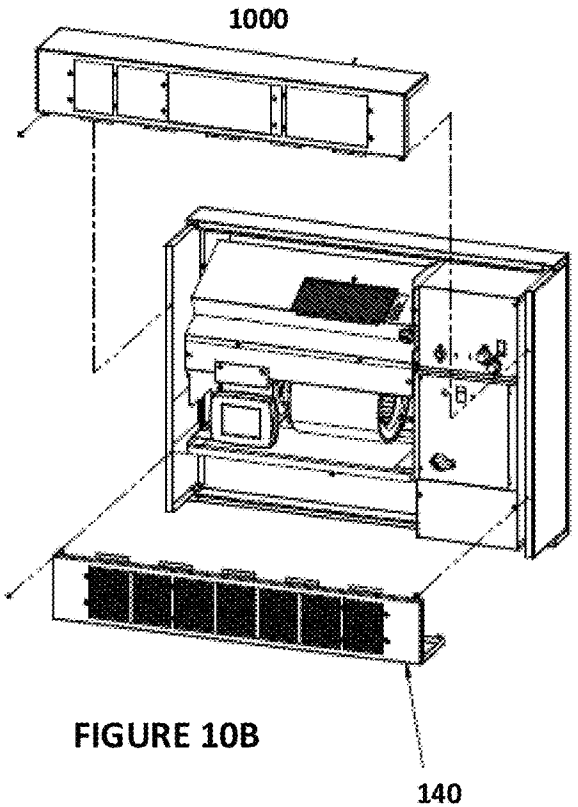
FIG. 10B illustrates air intake and exhaust components in accordance with an embodiment.
Figure 10A:
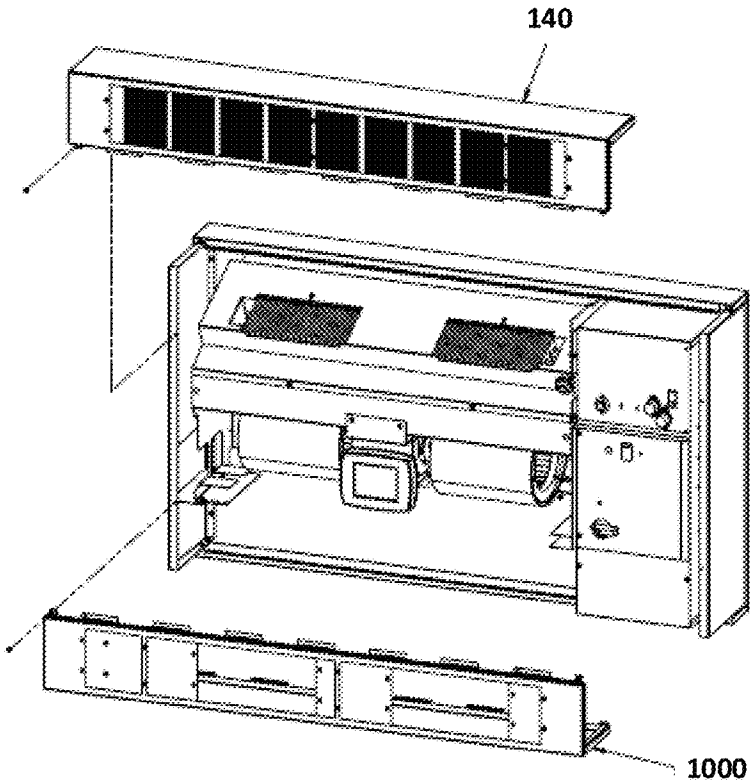
FIG. 10A illustrates air intake and exhaust components in accordance with an embodiment.

FIGS. 10A-10B illustrate air intake and exhaust components in accordance with embodiments. In an embodiment illustrated in FIG. 10A, a cabinet heater can comprise at least two heating elements and blower units, with the thermostat placed centrally in the air plenum. In FIG. 10B, the illustrated embodiment comprises a single heating element and blower unit, with the thermostat positioned off-center, but also within the air plenum in the main cavity. The air intake and exhaust components 1000 can be optionally placed above or below the heating element, thermostat, and air moving units. A grille 140 can be placed in front of the components as well. The placement and design of the intake and exhaust components 1000 can be adjusted based on any of a plurality of considerations, including but not limited to, a number of heating elements, and number of air moving units, a size of the main cavity, housing unit, and cabinet heater.

Figure 11B:
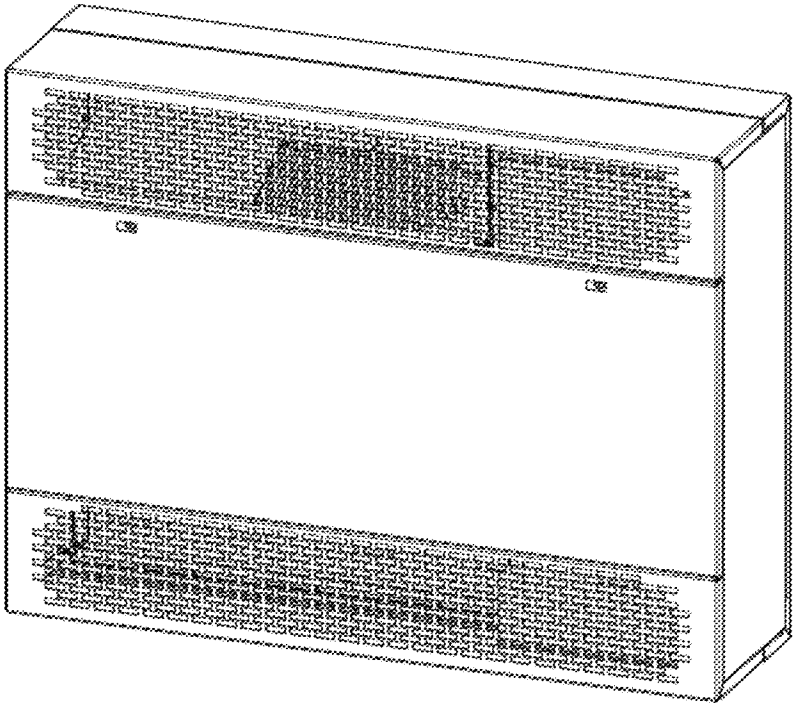
FIG. 11B illustrates a cabinet heater system with a front panel in place, in accordance with embodiments.
Figure 11A:
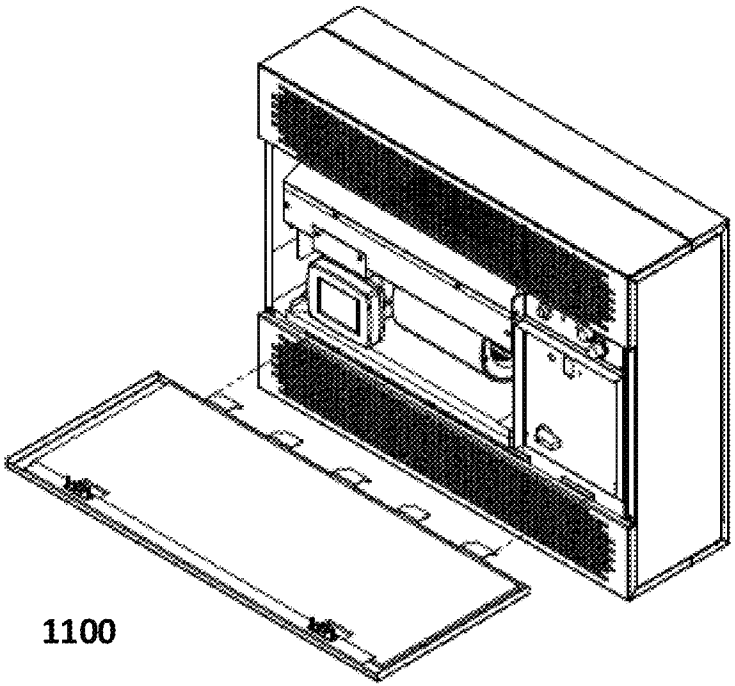
FIG. 11A illustrates a cabinet heater system with a front panel removed, in accordance with embodiments.

FIGS. 11A-11B illustrate an exemplary cabinet heater, in accordance with embodiments, further comprising a front panel 1100 that can be removably attached to the housing unit 150. In FIG. 11A, the front panel 1100 is removed, thereby exposing the main cavity, including the thermostat, blower units, and heating elements. FIG. 11B illustrates the cabinet heater in a closed position, with the front panel attached. The panel 1100 can be attached to the housing unit using a variety of means, including but not limited using a plurality of prongs, hinges, fasteners, and the like. Any of a variety of means and designs can be implemented to allow for removal of the front panel to provide access to the components beneath.

In embodiments, the panel 1100 can be fully or partially removable. The panel can be a door. The panel 1100 can be locked, in embodiments, or otherwise secured, for example, to prevent unintentional exposure of the controls, protect unintended access, damage, and/or to help maintain a certain temperature within the cabinet section, among others. The panel 1100 can further comprise a layer of insulation. As discussed herein, one or more panels can cover both the control cabinet and the main cavity. In embodiments, each section can be accessed separately. In other embodiments, each section is accessed upon removal of the panel. In various embodiments, the control cabinet can comprise an additional panel beneath the front panel 1100. In other embodiments, the control cabinet can be kept open for easier access. It will be appreciated that each of the designs and implementations discussed herein can be modified, for various purposes such as aesthetics, shielding, protection, and the like, and fall within the scope of the embodiments discussed herein.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cabinet heater, comprising:

a housing forming a cavity comprising a heating unit and an air moving device;

a thermostat removably mounted within the cavity, the thermostat comprising an internal temperature sensor configured to sense temperature within an air plenum formed in the cavity and configured to adjust at least one of the heating unit and the air moving device to maintain a set temperature within the air plenum;

a mounting unit comprising a first plate and securing a position of at least one of the heating unit, the air moving device, and the thermostat, the thermostat being disposed beneath the mounting unit, wherein the heating unit is disposed on a first face of the first plate of the mounting unit, the air moving device is disposed on a second face of the first plate of the mounting unit, and the air moving device is disposed opposite the heating unit; and a control compartment, separate from the cavity, retaining controls configured to adjust the thermostat.

2. The cabinet heater of claim 1, further comprising a thermostat mount positioned within the cavity, comprising:

an upper bar secured to the mounting unit and a second plate;

a third plate positioned beneath and behind the second plate and attached to the thermostat; and a stability bar positioned behind the third plate and securing the housing to prevent movement of the mounting unit.

3. The cabinet heater of claim 2, wherein the thermostat mount comprises at least one of: a wire protector, a wire pathway, and a strain relieving grommet.

4. The cabinet heater of claim 1, wherein the thermostat is mounted within the cavity using at least one hook to secure the position of the thermostat within the cavity.

5. The cabinet heater of claim 1, wherein an area above the mounting unit containing the heating unit is thermally separated from an area below the mounting unit.

6. The cabinet heater of claim 5, wherein the area above the mounting unit and the area below the mounting unit are thermally separated using one or more of: an air-blocking baffle, a cover placed on the mounting unit, and insulation panels.

7. The cabinet heater of claim 1, wherein the housing comprises a removable outer panel enclosing the cavity.

8. The cabinet heater of claim 7, wherein the outer panel comprises an insulation layer.

9. The cabinet heater of claim 7, wherein the outer panel is removably coupled to the housing with at least one hinge.

10. The cabinet heater of claim 7, wherein, in an open position, the outer panel is removed to expose at least one of the heating unit, the air moving device, and the thermostat.

11. The cabinet heater of claim 1, wherein the housing comprises one or more panels removably covering the cavity and the control compartment.

12. The cabinet heater of claim 1, wherein the air moving device is a cylindrical blower.

13. The cabinet heater of claim 1, wherein the controls are configured to adjust the thermostat in response to received temperature information.

14. The cabinet heater of claim 1, wherein the controls are configured to execute a program comprising automatic adjustments to the thermostat.

15. The cabinet heater of claim 1, wherein the controls are operated at least one of: manually, remotely, digitally, and automatically.

16. The cabinet heater of claim 1, wherein the cavity is surrounded by an insulation layer.

17. The cabinet heater of claim 1, wherein the controls are further configured to adjust the heating unit and the air moving device.

18. The cabinet heater of claim 1, wherein the thermostat is disposed in an area below the mounting unit.

19. The cabinet heater of claim 1, wherein an air outlet of the air moving device is disposed opposite the heating unit.

20. The cabinet heater of claim 19, wherein the air outlet of the air moving device spans a length and/or a width of the heating unit.

* * * * *